US006293170B1

(12) United States Patent
Hajianpour

(10) Patent No.: US 6,293,170 B1
(45) **Date of Patent: *Sep. 25, 2001**

(54) APPARATUS FOR OPENING CONTAINERS WITH TWIST-OFF TOPS

(76) Inventor: Mohammed Ali Hajianpour, 1706 Vestal Dr., Coral Springs, FL (US) 33071

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/343,664

(22) Filed: Jun. 29, 1999

(51) Int. Cl.[7] ..... B67B 7/00
(52) U.S. Cl. ..... 81/3.2; 81/3.25
(58) Field of Search ..... 81/3.2, 3.25

(56) References Cited

U.S. PATENT DOCUMENTS 4,171,650 * 10/1979 Cardinal ..... 81/3.2
5,167,172 * 12/1992 Heebner ..... 81/3.2
5,203,236 4/1993 Anderson ..... 81/3.2
5,271,296 * 12/1993 Parent et al. ..... 81/3.2
5,329,831 7/1994 Pierce, Jr. et al. ..... 81/3.43
5,365,806 11/1994 Paramest ..... 81/3.09
5,647,251 7/1997 Hardman ..... 81/3.2

* cited by examiner

*Primary Examiner*—Joseph J. Hail, III
*Assistant Examiner*—David B. Thomas
(74) *Attorney, Agent, or Firm*—Ronald V. Davidge

(57) ABSTRACT

A container opening device has a base and an upper carriage, sliding on posts extending upward from the base. The upper carriage has a downward facing upper platen, and the base has an upward facing lower platen which is rotated by a motor in response to the depression of a knob sliding on the upper carriage. In a first version, electrical contacts within the carriage close an electrical circuit between the posts when the knob is depressed. In a second version, a pushrod in the carriage, moved by depression of the knob, causes a shaft extending upward from the base to pivot, so that contacts in a switch controlling the motor are closed.

8 Claims, 3 Drawing Sheets

APPARATUS FOR OPENING CONTAINERS WITH TWIST-OFF TOPS

BACKGROUND OF THE INVENTION

1. Field of the Invention

This invention relates to apparatus for opening containers with twist-off tops, and, more particularly, to appliances for opening such containers held between a stationary platen and a rotating platen of the appliance.

2. Background Information

Conventional apparatus for opening jars and bottles generally consists of hand-held devices providing means to aid the user in gripping the edge of the top of the jar or bottle so that the top can be twisted off. However, since this type of device does not assist in holding the jar itself, excluding the top, often the jar itself cannot be held without slipping when an attempt is made to remove the top. Also, the normal forces necessary to provide sufficient torque to twist a stuck lid may be enough to crush the top. Furthermore, since the tops of jars and bottles vary greatly in diameter, it is difficult to configure a device of this type to handle a sufficient variation in types of containers, and the user is required to reset the device between its use on different types of jars and bottles.

An example of this type of device is found in U.S. Pat. No. 5,365,806, which describes a three-in-one mechanical remover for bottle caps, bottle corks, and jar caps of various sizes. The device includes a vice system along a hand-held vertical post, with a moving toothed rubber vice grip being manually driven with a vice screw along the vertical post. The jar top is gripped between the moving toothed rubber vice grip and a stationary rubber vice grip extending outward from the opposite end of the vertical post.

Other examples of the patent literature describe counter top or wall-mounted appliances which overcome some of the disadvantages of hand-held devices, including the danger of having a glass container break from overstressing while it is being manually held. For example, U.S. Pat. No. 5,203,236, describes a wall-mounted lid-starter having a pair of belts, respectively enclosing a lid and a container for starting an overtightened lid from the container. A first end of the lid belt is spring biased to cooperate with a motor coupled to pull the belt second end in applying torque to the lid. Rotatable arms facilitate receiving the lid and container within the belts. The belts have sufficient stiffness to define receiving loops. In use, a container is inserted upwards into these loops until the container lid depresses a starter button mounted in a protruding housing shelf, causing the belts to be automatically pulled about the lid and container with the aid of pulling mechanisms, such as electric motors, within the housing.

While the appliance described above appears to be quite effective in loosening the lids of similar jars, what is needed is a method which is quickly adaptable for loosening the tops or lids of a number of different types of containers. Furthermore, to speed the process of opening containers, what is needed is an appliance which can begin the process of unscrewing a lid without first performing a separate step of tightening belts.

U.S. Pat. No. 5,647,251 describes a fully automatic jar opener having substantially horizontal clamps automatically movable along a horizontal plane between an open position and a jar clamping position. The clamps, while in a jar clamping position, hold a jar substantially without slippage, and a top jar retainer holds the cap substantially without slippage when the cap is subjected to a twisting force. A vertical drive automatically adjusts the relative vertical positions between the bottom and top retainers to apply a holding force on the cap. The automatic jar opener includes at least one motor for applying the twisting force to the top retainer, for moving the clamps along the horizontal plane, and for adjusting the relative vertical position between the retainers. A controller automatically controls the motor and enables loosening of the cap with one single, discrete user command.

U.S. Pat. No. 5,271,296 describes an automated cap remover and method for cap removal including a drive for causing relative rotation to occur between a container cap and a cap engaging unit. The drive brings the cap engaging unit into engagement with the cap and then slips to permit the cap to be unscrewed from the container. A control unit senses the torque created by the relative motion between the cap and the cap engaging unit, and when a drop in torque is sensed, the control unit causes the drive to move the cap and cap engaging unit out of engagement.

The jar opener of U.S. Pat. No. 5,647,251 thus requires three separate mechanical drives, while the automated cap remover of U.S. Pat. No. 5,271,296 requires two separate drives, including a slip clutch allowing vertical movement of the cap opposite the direction in which it is engaged as unscrewing takes place. What is needed is an appliance performing the jar opening function with a single mechanical drive.

SUMMARY OF THE INVENTION

According to a first aspect of the present invention, there is provided apparatus for opening a container having a twist-off top. The apparatus includes a base, a carriage, a knob, a platen drive, and control means. The base includes an upward-facing lower platen. The carriage includes a downward-facing upper platen displaced above the lower platen. The carriage is movable in a first direction toward the lower platen and opposite this first direction. The knob is movable to cause movement of the upper platen in the first direction. The platen drive causes relative rotation between the upper and lower platens. The control means causes operation of the platen drive, with the control means operating in response to relative movement between the knob and the first carriage.

DETAILED DESCRIPTION

Figure 1:
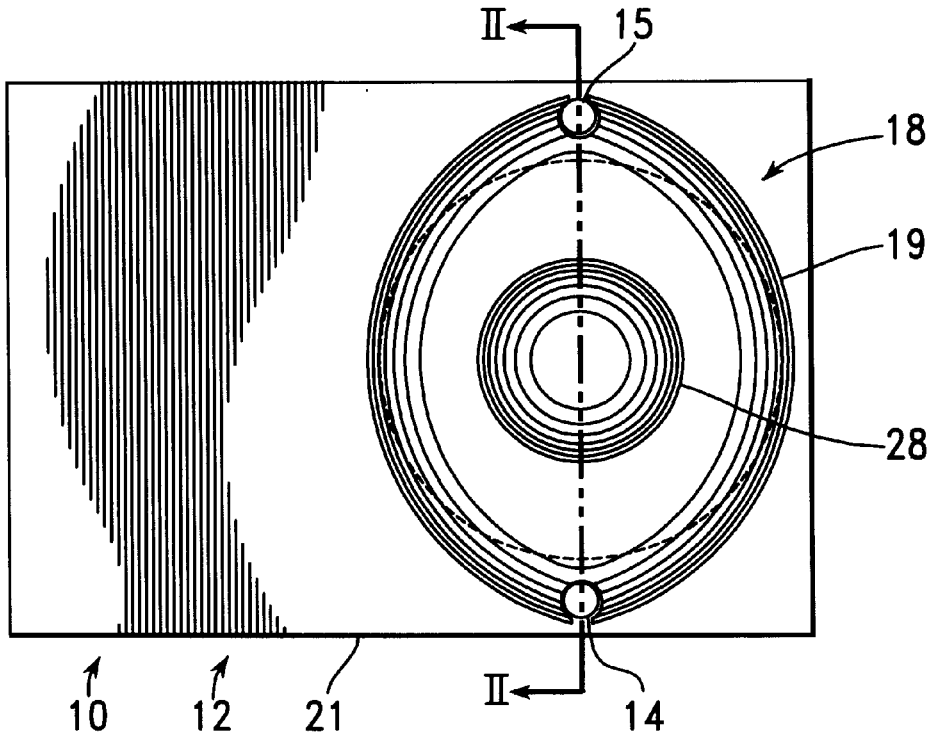
FIG. 1 is a plan view of a container opening device built in accordance with the present invention.
Figure 2:
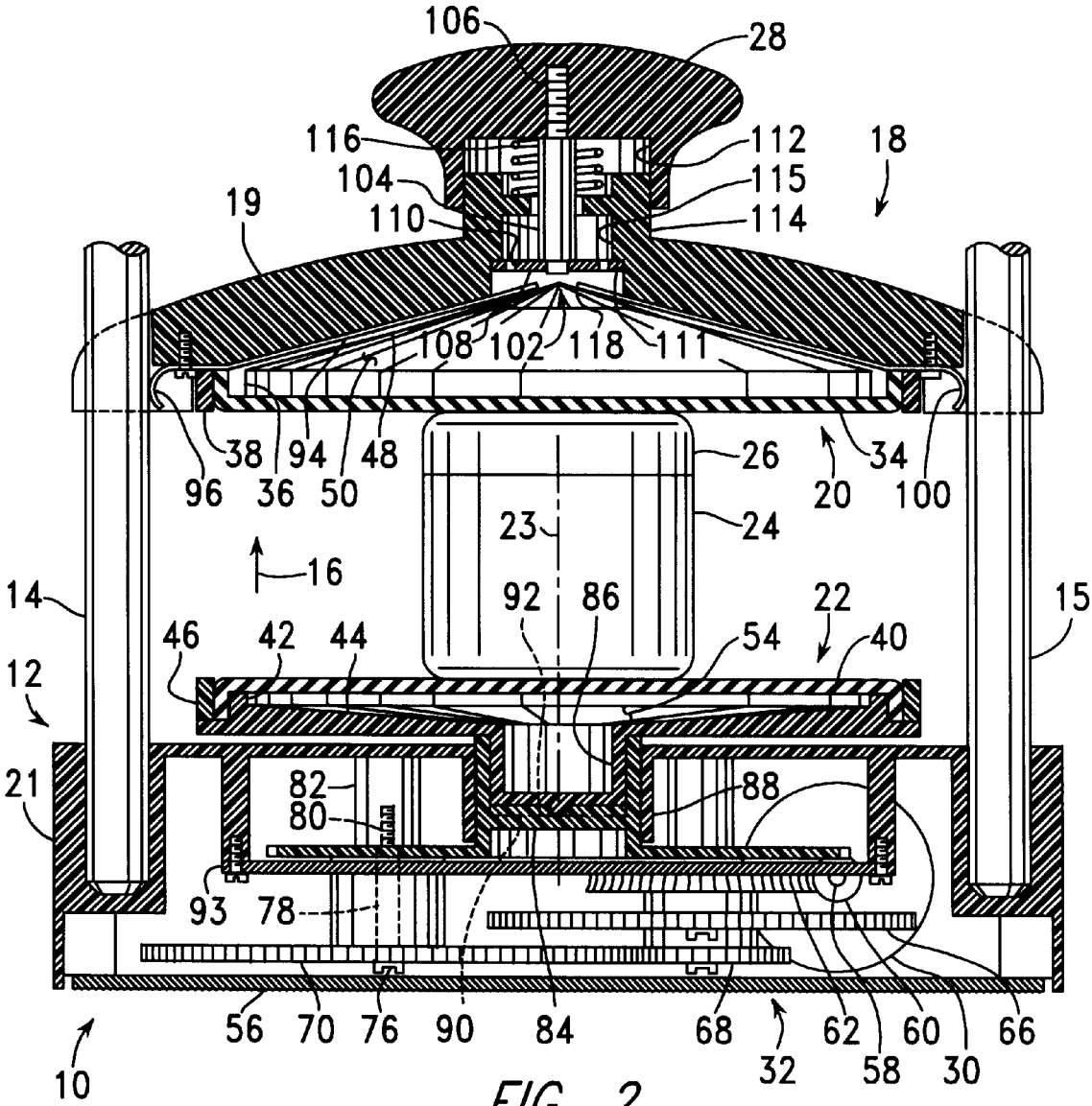
FIG. 2 is a vertical cross-sectional elevation of the device of FIG. 1, taken as indicated by section lines II—II in FIG. 1.

FIG. 1 is a plan view of a container opening device, generally indicated as 10, built in accordance with the present invention, and FIG. 2 is a vertical cross section thereof, taken as indicated by section lines II—II in FIG. 1.

Referring to FIGS. 1 and 2, the container opening device 10 includes a base portion, generally indicated as 12, from which a pair of posts 14, 15 extend upward, in the direction of arrow 16, and a carriage, generally indicated as 18, which slides in and opposite the direction of arrow 16 on the posts 14, 15. The carriage 18 includes a carriage cover 19 and a downward-facing upper platen, generally indicated as 20, while the base portion 12 includes a base cover 21 and a lower platen, generally indicated as 22, which is driven in rotation about a vertical axis of rotation 23. In the use of the device 10, a container 24, having a twist-off lid 26 to be removed, is placed between the upper and lower platens 20, 22. An actuation knob 28, slidably mounted atop the carriage 18, is used both to position the carriage 18 and to control the operation of a motor 30 used to rotate the lower platen 22 about its axis of rotation 23 through a gear train generally indicated as 32.

The upper platen 20 includes an elastomeric cover 34 which is stretched over a ring 36 extending downward as a portion of the carriage cover 19 to be held in place by a retaining ring 38. Similarly, the lower platen 32 includes an elastomeric cover 40 which is stretched over a ring 42 extending upward as a portion of a rigid platen support structure 44, to be held in place by a retaining ring 46. The elastomeric covers 34, 40 are preferably composed of a material having extremely tacky exposed surfaces to aid in the gripping of a container, such as container 24, and its lid, such as lid 26. Good results have been obtained using DYCEM® Non slip pad supplied by Dycem, Warwick, R.I., USA. During the process of assembling the ring 38, 46 over the elastomeric cover 34, 40, soapy water applied to the inner surface of the ring is used to facilitate slipping the ring along the periphery of the elastomeric cover.

Carriage cover 19 includes a lower central surface 48 defining a cavity 50 into which the elastomeric cover 34 is deflected, allowing the elastomeric cover 34 to conform to the shape of the container lid. Similarly, the rigid platen support structure 44 includes a central upper surface 52 defining a cavity 54 into which the elastomeric cover 40 is deflected, allowing the elastomeric cover 40 to conform to the shape of the container. This conformity of the elastomeric covers 34, 40 provides a better grip on the container and its lid during the process of unscrewing the lid.

Figure 3:
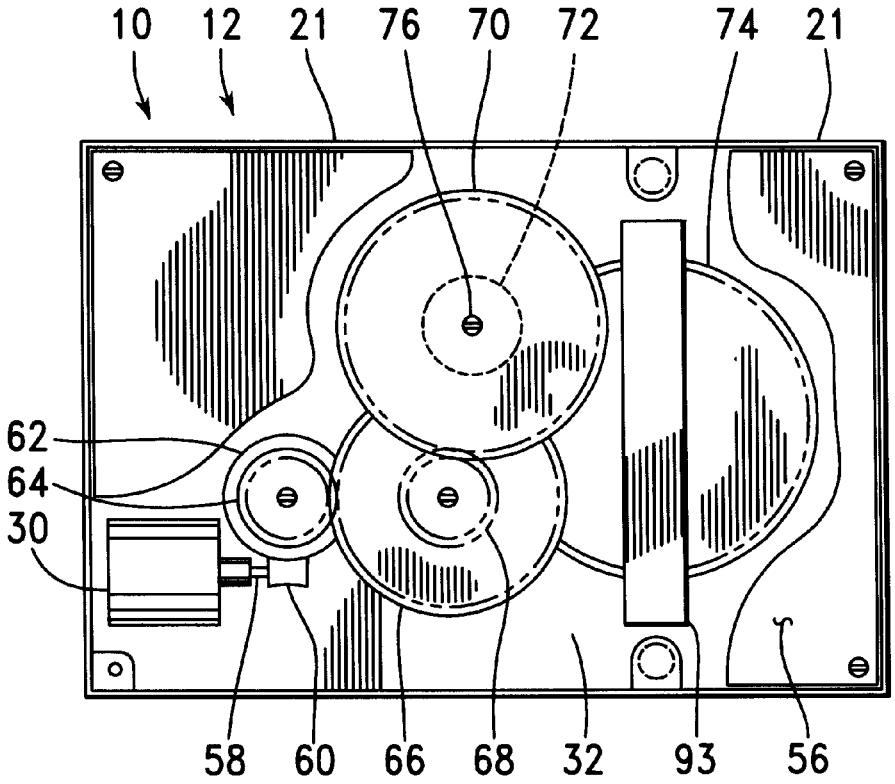
FIG. 3 is a bottom plan view of the device of FIG. 1, with a bottom cover partially broken away to show a gear train within the device.

Gear train 32, through which the motor 30 drives the lower platen 22 in rotation will now be explained, with continued reference being made to FIG. 1, and with additional reference being made to FIG. 3, which is a bottom plan view of the container opening device 10, in which a lower cover 56 of the base portion 12 is partly cut away to show the gear train 32. The motor 30 has, attached to its drive shaft 58, a worm 60, meshing with a worm wheel 62. Turning with the worm wheel 62, a first drive gear 64 meshes with a first driven gear 66. Turning with the first driven gear 66, a second drive gear 68 meshes with a second driven gear 70. Turning with the second driven gear 70, the third drive gear 72 meshes with a third driven gear 74. Each of the gears described as turning together are preferably formed as portions of a single part turning on a screw 76 having a shoulder 78 acting as a bearing and a threaded end 80 held within a descending post 82 forming part of the base cover 21. The third driven gear 74 forms part of a platen driving wheel 84, rotating within a descending sleeve 86 forming a portion of the base cover 21. The platen driving wheel 84 also includes coupling means engaging the platen support structure 44, with a cylindrical portion 86 of the platen support structure 44 extending downward into an upward facing cup portion 88 of the platen driving wheel 84, and with a cruciform key 90 from the platen support structure 44 extending downward into a cruciform slot 92 within the platen driving wheel 84. The platen driving wheel 84 is held in place by a plate 93 fastened to the base cover 21.

Continuing to refer to FIG. 2, the movement of knob 28 relative to the carriage cover 19 is used to control operation of the drive motor 30 by establishing electrical conduction between the electrically conductive posts 14, 15 which are conductive. For example, when a low electrical voltage applied to post 14 also appears on post 14, the motor 30 is operated.

The carriage 18 includes a first spring contact 94 with a curved section 96 sliding along post 14, and a second spring contact 98 with a curved section 100 sliding along post 15. Descending from the knob 28, a contact structure 102 includes a central post 104, with a threaded section 106 engaging the knob 28, and a contact plate 108. Holes 110 in the contact plate 108 form insertion points for pins in a tool (not shown) for tightening the contact structure 102 as a screw. Since the contact plate 108 extends under an annular step 111 in the carriage cover 19, the contact structure 102 holds the knob 28 on the carriage cover 19. The knob 28 is allowed to slide, relative to the carriage cover 19, in and opposite to the direction of arrow 16, with radial alignment of knob 28 being provided by the sliding engagement of a cylindrical cavity 112 within the knob 28 on an upstanding post 114 of the carriage cover 18, and also by the sliding engagement of the contact plate 108 within a cylindrical cavity 115 of the carriage cover 19.

When an external force is not applied to the knob 28, a compression spring 116 holds the knob 28 in the lifted position shown, with the contact plate 108 being held upward against the annular step 111. When the knob 28 is depressed, opposite the direction of arrow 16, the compression spring 116 is compressed, so that a downward force is applied to the carriage cover 19, and the contact plate 108 is brought into contact with the internal ends 118 of both spring contacts 94, 98, allowing an electrical current to flow between the posts 14, 15. When the knob 28 is subsequently released, the compression spring compression spring 116 causes the knob 28 to return upward, into the position in which it is shown, bringing the contact plate 108 out of contact with the internal ends 118 of the spring contacts 94, 98, so that the flow of electrical current between the posts 14, 15 is stopped.

Figure 4:
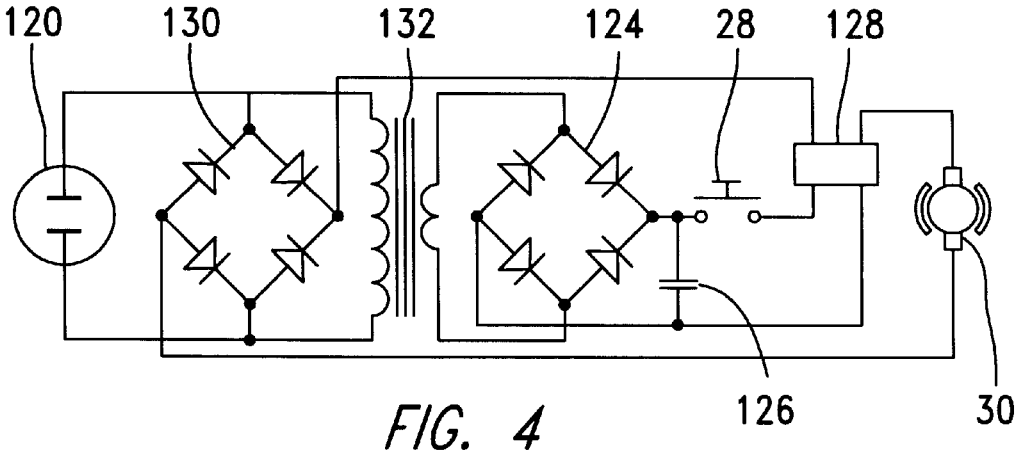
FIG. 4 is a schematic view of electrical apparatus within the device of FIG. 1.

FIG. 4 is a schematic view of electrical circuits within the container opener 10, used to control operation of the motor 30 in response to depression of the knob 28. An AC line input voltage, of, for example, 110 volts, from a line cord plug 120 is applied as an input to an isolation transformer 122. The output of this transformer 122 is at a low voltage, such as six volts, and is electrically isolated from the line voltage input to the transformer 122. This output of transformer 122 is provided as an input to a first rectifier 124 to produce low-voltage direct current, which is filtered using a capacitor 126 to reduce the level of ripple on the voltage signal.

The mechanism described above in reference to FIG. 2 for establishing electrical conductivity between the posts 14, 15 is shown in FIG. 4 as a pushbutton switch which is closed by the depression of the knob 28. When this pushbutton switch 28 is closed, a low-voltage signal is applied to a solid-state relay 128, causing the output of a second rectifier 130 to be applied across the terminals of the motor 30. The input to the second rectifier 130 is taken directly from the line voltage supplied through plug 120, so relay 128 provides a rectified signal derived from this voltage of the motor 30, which is a DC motor operable at this voltage. If it is desired that the motor 30 is operated at a different voltage, such as 48 volts, another coil of the transformer 122 may be used to provide a suitable signal as an input to the second rectifier 130. In this way, the motor 30 is driven in response to the depression of the knob 28, being turned on when the knob is depressed and off when the knob is released.

A DC motor is used in this application because such devices have excellent torque characteristics. Alternately, an induction motor may be used, preferably with a centrifugal clutch allowing the motor to reach a predetermined speed before actuating the clutch to couple the output of the motor to the gear train. This type of induction motor is well known to those of ordinary skill in the art, having been used, for example, in electric typewriters.

Figure 5:
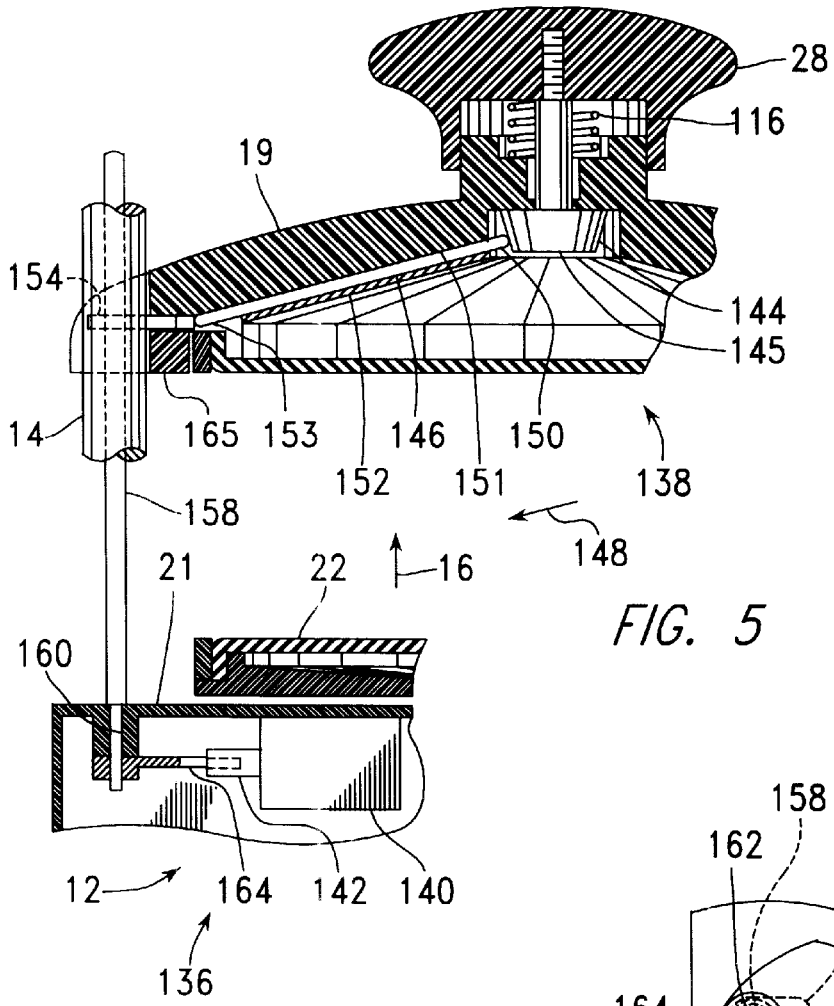
FIG. 5A is a fragmentary vertical cross-sectional elevation of an alternative embodiment of the present invention.
Figure 6:
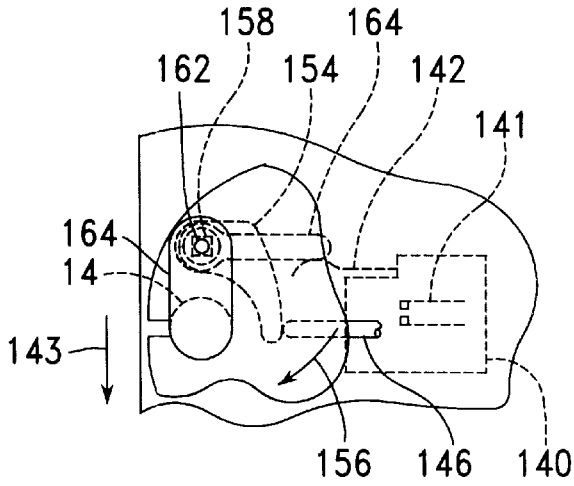
FIG. 6 is fragmentary plan view of the alternative embodiment of FIG. 5.

FIGS. 5 and 6 are fragmentary views of a second embodiment 136 of the present invention, in which a mechanical linkage 138 is used to transfer the movement of the knob 28, opposite the direction of arrow 16 relative to the carriage cover 19, to a switch 140 within the base 12. FIG. 5 is a fragmentary vertical cross-sectional view of this embodiment, while FIG. 6 is a fragmentary plan view thereof. Elements which are similar to those described in the preceding paragraphs are accorded common reference numbers with the previously-described elements. The switch 140 is preferably of a conventional type having contacts 141 which are closed by a toggle mechanism upon movement of an actuator 142 in the direction of arrow 143.

Referring to FIGS. 5 and 6, in this embodiment 136, a plunger 144 including a truncoconical actuating section 145 is fastened to the knob 28, moving with the knob 28 during the compression and relaxation of the compression spring 116. Depression of the knob 28 causes a pushrod 146 to be moved outward, in the direction of arrow 148, with the inner end 150 of pushrod 146 being displaced by the actuating section 144. The pushrod 146 slides within a slot 151 of the carriage cover 19, being held in place by a support plate 152. This movement of the pushrod 146 causes the outer end 153 of pushrod 146 to push a pawl 154, rotating the pawl 154 in the direction of arrow 156.

The pawl 154 is mounted to slide in and opposite the direction of arrow 16 on a square shaft 158, which is in turn mounted within a hole 160 in the cover 21 and within a hole 162 in a plate 164 extending from the upper end of shaft 14, to pivot in and opposite the direction of arrow 156. The pawl 154 pivots with the square shaft 158, moving within a slot formed between the carriage cover 19 and a mounting block 165 attached to the cover 19. A crank 166 attached to the lower end of the shaft 158 pushes the actuator 142 of the switch 140, closing contacts 141 within the switch 140 to be closed, so that the motor 30 (shown in FIG. 2) is turned on to rotate the lower platen 22.

Referring again to FIG. 2 as well as FIG. 5. In using either embodiment 10, 136, the user first raises the carriage 18, if necessary, and places the container 24 to be opened in the space between the upper platen 20 and the lower platen 24. The user then depresses the knob 28, causing the upper platen 20 to be brought into contact with the top of the container lid 26. Continued pressure on the knob 28 cause an axial compression force to be developed through the container 24 and lid 26 between the platens 20, 22. Additional pressure on the knob 28 causes the motor 30 to be started to unscrew the lid 24. The unscrewing motion occurring with operation of the motor 30 stops when the user pulls the knob 28 upward to release the container 24 and lid 26 from the opening device 10, 136. This unscrewing motion is also stopped if the user releases the knob 28. While this can occur just after sufficient unscrewing motion has occur to assure that a stuck lid has been released, or after the lid has been completely unscrewed, it is desirable to leave the lid partly screwed on, because it is more difficult remove the lid and container from the device 10, 136 after they are completely separated. If necessary, the user can allow the carriage to move upward as the lid is unscrewed.

While the present invention has been described as causing the lower platen to rotate while the upper platen remains stationary, it a square shaft similar to shaft 158, rotationally driven by a gear train, can alternately be used to cause rotation of the upper platen by engaging a gear rotating with the square shaft and driving the upper platen, while the lower platen remains stationary.

Various other changes can be made to the exemplary embodiments shown and described herein without departing from the scope and spirit of the present invention, which is understood to be limited only by the appended claims.

What is claimed is:

1. Apparatus for opening a container having a twist-off top, wherein said apparatus comprises:

a base including an upward-facing lower platen;

first and second conductive posts extending upward from said base;

a carriage including a downward-facing upper platen displaced above said lower platen, wherein said carriage is movable along said first and second conductive posts;

a knob movable to cause movement of said upper platen in a first direction, toward said lower platen, wherein said knob is slidably mounted to move on said carriage through a predetermined distance parallel to movement of said carriage along said first and second conductive posts;

a spring, resisting movement of said knob in said first direction, and restoring said knob opposite said first direction;

a platen drive causing relative rotation between said upper and lower platens, wherein said platen drive includes an electrical motor, and control means causing operation of said platen drive, wherein said control means operates in response to relative movement between said knob and said first carriage, wherein said control means includes electrical contacts closed by movement of said knob in said first direction relative to said carriage, and closing said electrical contacts causes current to flow through said electrical motor, wherein said control means includes a first circuit applying a first voltage to said first conductive post, and a second circuit applying a second voltage across electrical contacts when said first contact is applied to said second conductive posts, and wherein said electrical contacts are within said carriage, establishing electrical contact between said first and second posts when said knob is fully moved in said first direction relative to said carriage, and breaking electrical contact between said first and second posts when said knob is released.

2. The apparatus of claim 1, wherein said control means additionally includes a solid-state relay causing current to flow within said second circuit when current flows within said first circuit.

3. The apparatus of claim 1, wherein said electrical contacts are within said base, said control means additionally includes a pivotally mounted non-circular shaft extending into said base and through said carriage, an arm causing said electrical contact to be closed with pivotal movement of said non-circular shaft, a pawl sliding with said carriage on said non-circular shaft and pivoting with said non-circular shaft, and a linkage causing said pawl to be pivoted when said knob is moved in said first direction relative to said carriage.

4. The apparatus of claim 3, wherein said linkage includes:

a post having an inclined surface moving with said knob; and a pushrod extending between said inclined surface and said pawl to pivot said pawl in response to movement of said knob in said first direction relative to said carriage.

5. Apparatus for opening a container having a twist-off top, wherein said apparatus comprises:

a base including an upward-acing lower platen having a support structure with a peripheral ring and a central cavity, and an elastomeric cover stretched over said peripheral ring and said central cavity;

first and second conductive posts extending upward from said base, a carriage including a downward-facing upper platen having a support structure with a peripheral ring and a central cavity, and an elastomeric cover stretched over said peripheral ring and said central cavity, wherein said upper platen is displaced above said lower platen, and wherein said carriage is movable along first and second conductive posts, sliding on said first and second conductive posts in a first direction toward said lower platen;

a knob movable to cause movement of said upper platen in said first direction, wherein said knob is slidably mounted to move on said carriage through a predetermined distance parallel to movement of said carriage along said first and second conductive posts;

a spring, resisting movement of said knob in said first direction, and restoring said knob opposite said first direction, wherein movement of said knob in said first direction causes movement of said carriage in said first direction;

a platen drive causing relative rotation between said upper and lower platens, wherein said platen drive includes an electrical motor, and control means causing operation of said platen drive, wherein said control means operates in response to relative movement between said knob and said carriage, wherein said control means includes electrical contacts closed by movement of said knob in said first direction relative to said carriage, wherein closing said electrical contacts causes current to flow through said electrical motor, wherein said control means includes a first circuit applying a first voltage to said first conductive post, and a second circuit applying a second voltage across electrical contacts when said first contact is applied to said second conductive posts, and wherein said electrical contacts are within said carriage, establishing electrical contact between said first and second posts when said knob is fully moved in said first direction relative to said carriage, and breaking electrical contact between said first and second posts when said knob is released.

6. The apparatus of claim 5, wherein said control means additionally includes a solid-state relay causing current to flow within said second circuit when current flows within said first circuit.

7. Apparatus for opening a container having a twist-off top, wherein said apparatus comprises:

a base including an upward-facing lower platen having a support structure with a peripheral ring and a central cavity, and an elastomeric cover stretched over said peripheral ring and said central cavity;

a pair of posts extending upward from said base;

a carriage including a downward-facing upper platen having a support structure with a peripheral ring and a central cavity, and an elastomeric cover stretched over said peripheral ring and said central cavity, wherein said upper platen is displaced above said lower platen, and wherein said carriage slides on said pair of posts in a first direction toward said lower platen;

a knob movable to cause movement of said upper platen in said first direction, wherein said knob is slidably mounted to move on said carriage through a predetermined distance parallel to movement of said carriage along said first and second conductive posts;

a spring, resisting movement of said knob in said first direction, and restoring said knob opposite said first direction, wherein movement of said knob in said first direction causes movement of said carriage in said first direction;

a platen drive causing relative rotation between said upper and lower platens, wherein said platen drive includes an electrical motor, and control means causing operation of said platen drive, wherein said control means operates in response to relative movement between said knob and said carriage, wherein said control means includes electrical contacts closed by movement of said knob in said first direction relative to said carriage, wherein closing said electrical contacts causes current to flow through said electrical motor, wherein said electrical contacts are within said base, and wherein said control means additionally includes a pivotally mounted non-circular shaft extending into said base and through said carriage, an arm causing said electrical contact to be closed with pivotal movement of said non-circular shaft, a pawl sliding with said carriage on said non-circular shaft and pivoting with said non-circular shaft, and a linkage causing said pawl to be pivoted when said knob is moved in said first direction relative to said carriage.

8. The apparatus of claim 7, wherein said linkage includes:

a post having an inclined surface moving with said knob; and a pushrod extending between said inclined surface and said pawl to pivot said pawl in response to movement of said knob in said first direction relative to said carriage.

* * * * *